United States Patent [19]

Mize

[11] 3,946,772

[45] Mar. 30, 1976

[54] CLOSURE GATE APPARATUS HAVING MATERIAL FLOW GUIDING STRUCTURE

[75] Inventor: Erbie Gail Mize, Chattanooga, Tenn.

[73] Assignee: Astec Industries, Inc., Chattanooga, Tenn.

[22] Filed: Sept. 13, 1974

[21] Appl. No.: 505,672

[52] U.S. Cl. ..... 141/98; 220/347; 220/351

[51] Int. Cl.[2] ..... B65B 1/04

[58] Field of Search ..... 220/345–351; 141/98, 154, 350; 222/461, 559, 52, 561

[56] References Cited

UNITED STATES PATENTS

| | | | |
|---|---|---|---|
| 3,339,785 | 9/1967 | Nugent | 220/346 X |
| 3,386,206 | 6/1968 | Loveless | 220/345 X |
| 3,417,896 | 12/1968 | Loveless | 220/345 X |
| 3,532,252 | 10/1970 | Brock | 222/52 |

*Primary Examiner*—Robert B. Reeves
*Assistant Examiner*—David A. Scherbel
*Attorney, Agent, or Firm*—Jones, Thomas & Askew

[57] ABSTRACT

Apparatus for selectively opening and closing a fluid-tight sealing gate for a storage bin or the like. A gate closure member is mounted on a carriage which is supported for lateral movement relative to a material flow opening. As the carriage assembly is laterally moved by a linear actuator, the closure member is moved in a direction perpendicular to the material flow opening to accomplish sealing and unsealing of the opening in proper timed relation with the lateral movement of the carriage assembly. A material flow guiding structure is connected to the carriage assembly for movement into position adjacent the material flow opening, as the carriage assembly is laterally moved to withdraw the closure member from closure relation with the flow opening.

10 Claims, 3 Drawing Figures

CLOSURE GATE APPARATUS HAVING MATERIAL FLOW GUIDING STRUCTURE

This invention relates in general to closure gate apparatus and in particular to gate apparatus for selectively closing and sealing an opening in a storage bin or the like.

Bulk storage bins are frequently used in various environments and manufacturing operations to provide a location for the temporary or semi-permanent storage of a flowable material. One example of the use of storage bins is found in connection with plants and equipment used in the manufacture of asphalt aggregate material for paving purposes, wherein an asphalt plant may provide more-or-less a continuous flow of asphalt aggregate material. The asphalt aggregate material produced by the plant is, however, typically transported in truckload batches from the plant to the actual paving site, and a storage bin known as a surge bin is typically used for temporary storage of the asphalt aggregate material produced by an operating asphalt plant. Those skilled in the art are aware that hot asphalt aggregate mix rapidly deteriorates through oxidation, when stored in exposure to air, and so hot asphalt storage bins are typically provided with some means for maintaining an inert or non-oxidizing atmosphere in the free space within the storage bin. One such means is shown in U.S. Pat. No. 3,820,687. Both the inlet opening of the storage bin and the asphalt discharge opening of the bin must, therefore, be equipped with gates which not only prevent unwanted material flow, but which also maintain a fluid-tight seal to maintain the non-oxidizing atmosphere within the bin and to prevent entry of ambient atmosphere into the bin.

Although hot asphalt mix is usually introduced into an asphalt storage bin by gravity flow from a conveyor into an opening at the top of the bin, this top opening must be maintained in closed and fluid-tight sealed relation, except when asphalt mix is actually being added to the storage bin, so as to maintain the inert atmosphere provided within the bin. Prior art techniques for closing and sealing the top opening of an asphalt storage bin are shown in U.S. Pat. No. 3,532,252, by way of example, and include a door assembly which is selectively movable to open or close the top opening of the bin. The requisite fluid-tight sealing between the top inlet opening and the door is accomplished through a fluid seal arrangement including a number of fluid actuators which must be operated to seal or to unseal the door, after which another actuator is operated to cause actual opening or closing of the door. An extensive and elaborate arrangement of interlocking controls is provided to ensure that the door actuator and the separate seal actuators can be operated only in the proper sequence, so as to prevent damaging the top door structure through careless or uninformed operation of the top gate controls. Such top gate sealing apparatus of the prior art is generally expensive to manufacture, and has a control complexity which is subject to substantial maintenance in operation.

Accordingly, it is an object of the present invention to provide improved sealing gate apparatus.

It is another object of the present invention to provide improved sealing gate apparatus for use with a material storage bin.

It is yet another object of the present invention to provide improved sealing gate apparatus for the top opening of an asphalt storage bin.

The foregoing and other objects and advantages of the present invention will become more readily apparent from the disclosed embodiment thereof, including the drawing in which.

Stated in general terms, the sealing gate of the present invention includes a gate closure means which is laterally movable to block or to unblock a material flow opening, and which is also movable in a perpendicular path relative to the flow opening to selectively provide a fluid tight sealing engagement of the closure with the opening. Means are provided to accomplish the lateral movement of the closure means, and the lateral movement means is interconnected with the closure means in such a way as to withdraw the closure means from sealing relation prior to lateral movement of the closure means away from blocking relation with the flow opening. Stated more particularly, the sealing gate apparatus of the present invention provides a carriage which is mounted for lateral movement relative to a material flow opening, and which carries a closure gate. The carriage is laterally moved by a suitable actuator, and an interconnection between the actuator and the carriage accomplishes timely sealing and unsealing movement of the closure.

The present invention is better described and understood with reference to the disclosed embodiment of sealing gate apparatus indicated generally at 10 in the Figures and disposed above a storage bin 11 shown in broken line. The storage bin 11 has a material flow opening 12 to admit material into the interior of the bin; it should be understood that the herein-described characterization of the storage bin 11 as a bin for storing hot asphalt mix is merely one example of a bin with which the sealing gate apparatus of the present invention may advantageously be used. The sealing gate apparatus 10 includes vertical support members 11 which may extend downwardly for connection with structure (not shown) of the storage bin 11, or to any other structural supporting surface.

Figure 1:
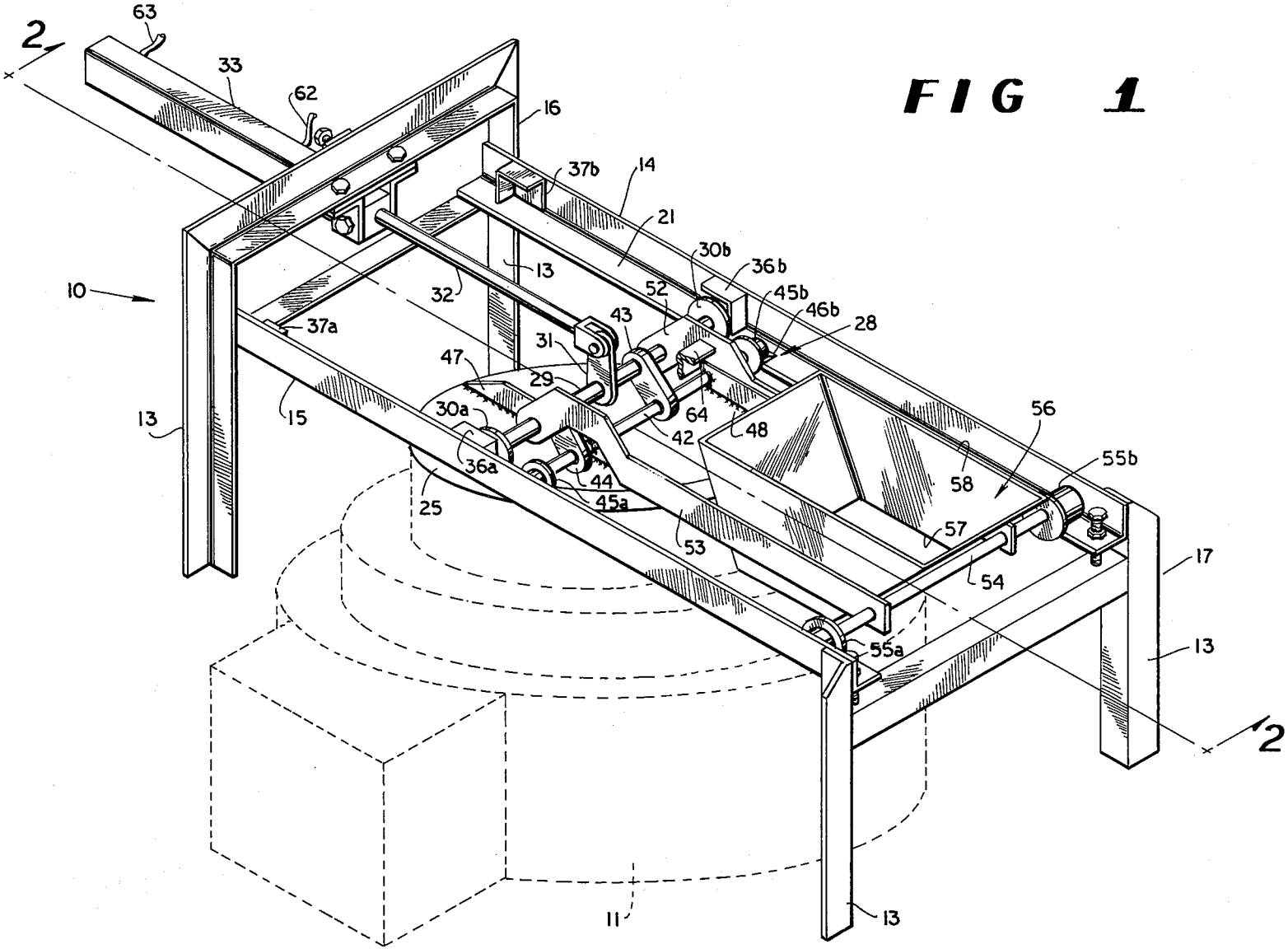
FIG. 1 shows a pictorial view of a top sealing gate according to the disclosed embodiment of the present invention.
Figure 3:
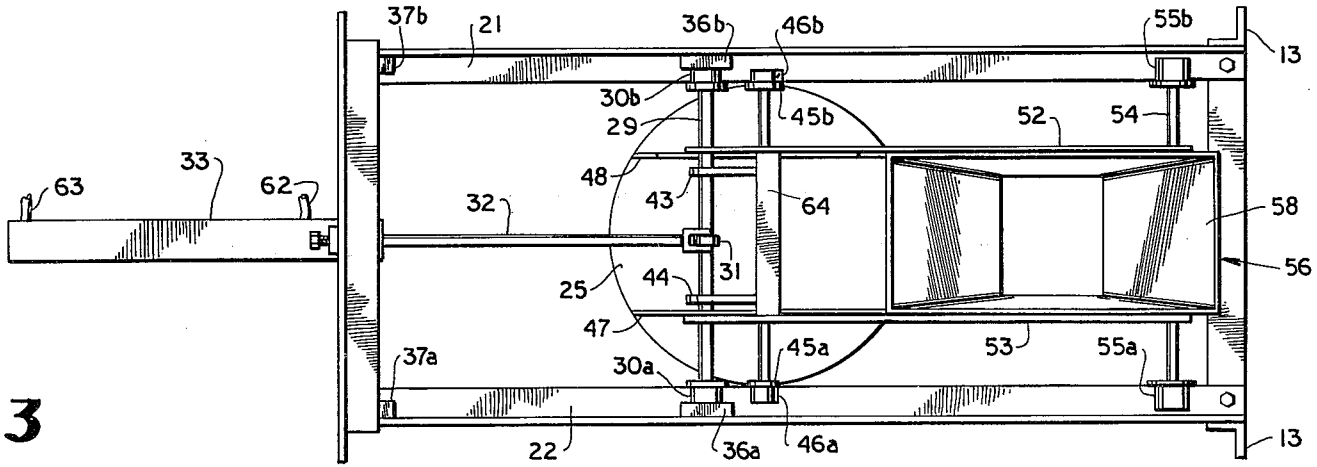
FIG. 3 shows a top plan view of the disclosed embodiment, with the sealing gate in closed position.

A pair of horizontal L-shaped structural members 14 and 15 extend between a first end 16 and a second end 17 of the gate apparatus, and it is particularly apparent in FIGS. 1 and 3 that the members 14 and 15 have respective upward-facing support surfaces 21 and 22. The surfaces 21 and 22 comprise track surfaces which extend laterally and along opposite sides of the flow opening 12.

Figure 2:
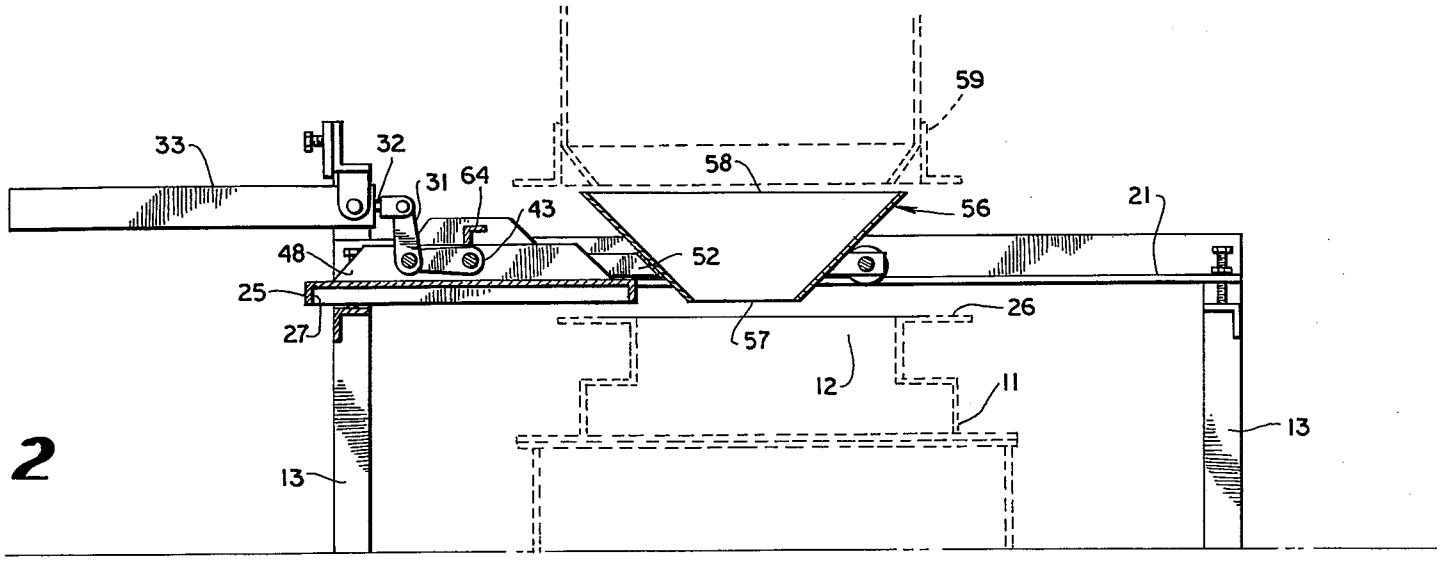
FIG. 2 shows a vertical section view taken along line 2—2 of FIG. 1, with the sealing gate open and retracted.

There is provided a closure gate 25 having external dimensions at least sufficient to completely surround and enclose the flow opening 12 in the storage bin. The flow opening 12 in the storage bin of the depicted embodiment is of generally circular configuration and is surrounded by an annular flanged surface 26, as best seen in FIG. 2. The closure gate 25 has an annular axially extending rim 27 which projects downwardly for contact with the flanged surface 26 to facilitate closure and sealing of the flow opening 11, and it will be understood that a suitable sealing gasket surface can optionally be provided on either or both of the confronting surfaces on the rim 27 and the flanged surface 26 to enhance the fluid-tight nature of the closure seal. It will also be understood by those skilled in the art that the herein-disclosed details of the closure structure, including the gate 25, the flanged surface 26, and the rim 27, are only exemplary of the specific embodiment disclosed herein and are not limiting features of the present invention.

The closure gate 25 is supported and moved by a carriage assembly indicated generally at 28 and including an axle 29 extending transversely between the two track surfaces 21 and 22. Flanged wheels 30*a* and 30*b* are rotatably attached to the ends of the axle 29, and are positioned for rolling movement along the respective track surfaces. A crank arm 31 is connected to the axle 29 intermediate the axle ends, and the free end of the crank arm is connected to the operating rod 32 of a suitable linear actuator such as the double-action fluid cylinder 33. A pair of forward motion stop members 36*a* and 36*b* are positioned with respect to each of the track surfaces 21 and 22 to define maximum movement of the wheels 30*a* and 30*b* in the forward position, as defined by extension of the operating rod 32. Another pair of motion stops 37*a* and 37*b* are mounted adjacent the first end 16 of the gate apparatus in a suitable position to limit the retracted position of the carriage assembly 28, in response to retraction of the operating rod 32.

The carriage assembly 28 further includes a second axle 42 which is supported in parallel and spaced-apart relation to the axle 29 by a pair of arms 43 and 44 through which the axle 42 is rotatably received. Each of the arms 43 and 44, as will become apparent, is the functional equivalent of a lever arm having the axle 29 as the fulcrum of rotation.

Flanged wheels 45*a* and 45*b* are rotatably mounted on the opposite ends of the second axle 42, and are received on the track surfaces 21 and 22 for rolling movement therealong. As best seen in FIGS. 1 and 3, each of the track surfaces 21 and 22 has a discontinuity 46*a* and 46*b*, taking the form of a cutaway portion of missing track surface in the disclosed embodiment, and the diameter and extent of the two wheels 45*a* and 45*b* is selected to permit such wheels to drop into the respective discontinuities 46*a*, 46*b* when the carriage assembly 28 is appropriately positioned by operation of the actuator 33. It is also apparent from FIG. 3 that the outermost axial extent of the wheels 45*a*, 45*b* is selected to permit such wheels to move laterally past the forward motion stops 36*a* and 36*b* without interference, as the carriage assembly is being laterally traversed by the actuator 33.

The closure gate 25 is connected to the carriage assembly 28 by way of a pair of rib members 47 and 48 which extend upwardly from attachment to the upper surface of the closure gate 25. The axle 42 extends through each of the rib members 47 and 48 and is affixed to such ribs.

The arms 52 and 53 are connected to the carriage assembly 28 and extend laterally in the forward direction from the closure gate 25 to terminate in connection with a third axle 54 parallel to and spaced apart from the axles 29 and 42. A pair of flanged wheels 55*a* and 55*b* are rotatably connected at the opposite ends of the axle 54. The arms 52 and 53 are mutually spaced apart to accommodate a material guide chute 56, which is secured to these two arm members. As best seen in FIG. 2, the bottom end 57 of the chute 56 is high enough to clear the flanged surface 26 extending around the flow opening 12 of the storage bin 11, when the carriage assembly 28 is laterally traversed to the retracted position. The top end 58 of the chute 56 is sufficiently low to enable the chute to pass beneath the lowermost portion of a material handling device 59, shown in phantom in the drawings. It will be understood that the material handling device 59 may be a material feed conveyor, a material flow chute, or any other apparatus which moves and/or directs material for admission into the flow opening 12 of the storage bin 11. It will also be understood that it is preferable to minimize the open space between the bottom of the material handling device 59 and the flow opening 12, while material is being admitted into the storage bin 11, so as to reduce the likelihood of flowing material missing the opening 12. The chute 56, when positioned between the material handling device 59 and the flow opening 12 of the storage bin 11, effectively provides a nearly-continuous guide structure for material flowing from the material handling device into the storage bin.

The operation of the sealing gate apparatus embodiment depicted and described above is now considered. The closure gate 25 is aligned with the flow opening 12 and maintained in sealing engagement with the opening, as long as the operating rod 32 of the actuator 33 is maintained in the extended position as shown in FIGS. 1 and 3. The wheels 45*a* and 45*b* are received within the discontinuities 46*a* and 46*b* at this time, allowing the axle 42 and the attached closure gate 45 to drop downwardly into the sealing position shown in FIGS. 1 and 3. The chute 56 is disposed in laterally spaced-apart relation to the flow opening 12 at this time.

When it is desired to admit material through the flow opening 12 into the storage bin, fluid pressure is applied to the actuator 33 through the conduit 62 and any suitable fluid valve arrangement (not shown) to retract the operating rod 32. Initial retracting movement of the operating rod 32 is applied through the crank arm 31 to rotate the axle 29 in the counterclockwise direction (as viewed in the Figs.) and thus to rotate the crank arms 43 and 44 relative to the axle 29. Rotation of the crank arms 43 and 44 causes the rotatably-attached second axle 42 to move upwardly, whereupon the closure gate 25 is raised upwardly away from the flow opening 12 in the storage bin. Upward movement of the axle 42 also raises the wheels 45*a* and 45*b* to remove the wheels from the discontinuities 46*a* and 46*b* in the track surfaces 21 and 22. The uppermost extent to which the axle 42 and the attached closure gate 25 can move is limited by the bar 64 extending between the arms 52 and 53.

When the axle 42 is moved upwardly into contact with the bar 64, or at least to the extent which removes the wheels 45*a* and 45*b* from the respective discontinuities in the track surfaces, the continuing retractive movement of the operating rod 32 commences lateral movement of the carriage assembly 28 to the left, as viewed in the Figs., to withdraw the closure gate 25 from alignment with the flow opening 12 and to position the chute 56 in alignment with the flow opening. The wheels 45*a* and 45*b* roll along the track surfaces 21 and 22, maintaining the axle 42 and the closure gate 25 in elevated relation at this time. The lateral retractive movement of the carriage assembly 28 continues until the wheels 30*a* and 30*b* engage the retract motion stops 37*a* and 37*b*, at which time the carriage assembly is effectively maintained in retracted position by the continued application of fluid pressure on the conduit 62 of the actuator 33. The dimensions of the arms 52 and 53 is selected to place the chute 56 into alignment with the flow opening 12, as shown in FIG. 2, when the carriage assembly is fully retracted, so that a flow of material from the material handling device 59 can be initiated.

Reclosure of the gate is accomplished by removing operating fluid pressure from the conduit 62 of the actuator 33 and applying fluid pressure to the conduit 63, whereupon the operating rod 32 commences to move outwardly from the actuator. The carriage assembly 28 traverses laterally in the direction opposite from retraction, displacing the chute 56 from the flow opening 12 and moving the closure gate 25 toward alignment with the flow opening. The forward motion stops 36*a* and 36*b* are spaced apart along the track surfaces 22 and 21 from the respective discontinuities 46*a* and 46*b* to cause the wheels 30*a* and 30*b* to engage the forward motion stops at the point of lateral carriage assembly travel which places the wheels 45*a* and 45*b* in alignment with the discontinuities 46*a* and 46*b*. The forward lateral motion of the carriage assembly 28 is thus terminated by the forward motion stops 36*a* and 36*b* at the point where the closure gate 25 is aligned with the flow openings 11, and continued extension of the operating rod 32 causes clockwise rotation of the axle 29 and downward movement of the axle 42 to lower the closure gate 25 into sealing relation with the flow opening 12. Fluid pressure may be maintained in the conduit 63 to provide positive locking of the closure gate in the closed and sealed position.

It will thus be seen that opening and closing of the flow opening 12, as well as sealing and unsealing of the closure gate, is accomplished in synchronized operation with only a single actuator and without need for the complex interlocking multiple controls and actuators which characterize the prior art.

It will be apparent that the foregoing relates only to a disclosed embodiment of the present invention, and that numerous changes and modifications may be made therein without departing from the spirit and the scope of the invention as defined in the following claims.

What is claimed is:

1. Gate apparatus for selectively opening and closing a material flow aperture, comprising:

closure means for a material flow aperture;

first means connected to said closure means and selectively operative to move said closure means either to a first position substantially aligned with such aperture or to a second position laterally displaced from such aperture;

second means interconnected between said closure means and said first means and responsive to further operation of said first means after attainment of said first position by said closure means to dispose said closure means in closure relation with such material flow aperture; and said second means being operative in response to initial movement of said first means in a direction away from said first position to withdraw said closure means from said closure relation.

2. Gate apparatus as in claim 1, wherein:

said second means includes track means mounted in laterally extending relation to such aperture;

support means disposed for movement along said track means and connected to support said closure in said withdrawn position; and said track means having a region which is engageable by said support means to move said closure means toward said closure relation.

3. Gate apparatus for selectively opening and closing a material flow aperture, comprising:

closure means for a material flow aperture;

first means connected to said closure means and selectively operative to move said closure means either to a first position substantially aligned with such aperture or to a second position laterally displaced from such aperture;

second means connected to said closure means and responsive to further movement of said first means upon attainment of said first position by said closure means to dispose said closure means in closure relation with such aperture;

said second means being responsive to initial movement of said first means away from said first position to withdraw said closure means from said closure relation;

said second means including track means mounted in laterally extending relation to such aperture;

support means disposed for movement along said track means and operative to support said closure in said withdrawn position; and said track means having a region which is engageable by said support means to move said closure means toward said closure relation with said aperture when said first means is moved to said first position.

4. Gate apparatus as in claim 3, wherein said region comprises a discontinuity in said track means.

5. Gate apparatus as in claim 3, wherein:

said second means further includes a crank operatively interconnected between said first means and said second means to provide positive withdrawal of said closure means from closure relation with such aperture in response to initial movement of said first means away from said first position.

6. Gate apparatus as in claim 3, further comprising:

material flow guide means operatively associated with said first means for movement into flow guiding relation with such aperture when said closure means is moved to said second position and for movement away from such aperture in response to movement of said closure means toward said first position.

7. Gate apparatus as in claim 6, wherein said flow guide means is supported by said track means for movement therealong in response to said first means.

8. Gate apparatus for selective closure of an opening, comprising:

closure means configured to obstruct such opening;

first means supporting said closure means for lateral movement with respect to such opening, said closure means being supported for lateral movement between a first position in alignment with such opening and a second position in laterally spaced apart relation to such opening;

motive means operatively connected to selectively urge said closure means either to said first position or to said second position;

second means operatively interconnected between said motive means and said closure means and operative in response to said urging away from said first position to withdraw said closure means from opening obstruction relation before said closure means is moved away from said first position, and additionally operative to return said closure means to opening obstruction relation when said closure means is moved to said first position.

9. Apparatus for selectively closing a flow opening, comprising:

a pair of support members flanking such opening and extending to a location laterally spaced apart from the opening;

carriage means supported by said support members for selective reciprocating movement between a first position in proximate relation to such opening and a second position laterally spaced apart from such opening;

closure means carried by said carriage means for movement between said first position in proximate confronting alignment with such opening and said second position laterally spaced apart from the opening;

motive means connected to move said carriage means selectively to either of said first and second positions; and said closure means being connected to said carriage means by further means responsive to further operation of said motive means after said carriage means becomes moved to said first position to urge said closure means into closure relation with such opening, and responsive to said motive means urging said carriage away from said first position to withdraw said closure means from said closure relation before said carriage means moves away from said first position.

10. Apparatus as in claim 9, wherein:

said further means comprises means operative to maintain said closure means in said withdrawn position in response to displacement of said carriage means away from said first position.

* * * * *